US005627020A

United States Patent [19]

Hahm et al.

[11] Patent Number: 5,627,020

[45] Date of Patent: May 6, 1997

[54] DOPED FINE GRAIN SILVER HALIDE GRAINS AS A MEANS OF INCORPORATING METAL DOPANT IN EMULSION FINISHING

[75] Inventors: Paul T. Hahm, Hilton; Walter H. Isaac, Penfield, both of N.Y.

[73] Assignee: Eastman Kodak Company, Rochester, N.Y.

[21] Appl. No.: 584,503

[22] Filed: Jan. 11, 1996

[51] Int. Cl.[6] ..... G03C 1/015; G03C 1/09

[52] U.S. Cl. ..... 430/569; 430/604; 430/605; 430/568

[58] Field of Search ..... 430/604, 605, 430/569, 568

[56] References Cited

U.S. PATENT DOCUMENTS

| | | | |
|---|---|---|---|
| 4,863,844 | 9/1989 | Okumura et al. | 430/569 |
| 4,865,962 | 9/1989 | Hasebe et al. | 430/567 |
| 5,043,258 | 8/1991 | Ihama et al. | 430/567 |
| 5,070,008 | 12/1991 | Maekawa et al. | 430/567 |
| 5,134,060 | 7/1992 | Maekawa et al. | 430/569 |
| 5,284,745 | 2/1994 | Ohshima | 430/569 |
| 5,391,474 | 2/1995 | Haefner et al. | 430/569 |
| 5,523,200 | 6/1996 | Hahm et al. | 430/569 |

OTHER PUBLICATIONS

Japan 2–103,032 published Apr. 16, 1990 (abstract enclosed).

Japan 6–230,503 published Aug. 19, 1994 (abstract enclosed).

*Primary Examiner*—Mark F. Huff

*Attorney, Agent, or Firm*—Paul A. Leipold

[57] ABSTRACT

The invention is directed to a method of forming a sensitized high chloride silver halide emulsion comprising providing a high chloride emulsion bringing a Lippmann emulsion comprising fine grains of silver bromide doped with metal into contact with said emulsion at a temperature of above 50° C. wherein said metal is present in an amount between 0.001 and 0.25 mg/silver mole, said bromide is present in an amount between 0.05 and 3.0 mole percent bromide and the relationship of bromide and metal dopant is M percent $Br=Xe^{-(Y \cdot Mt)}$, $X=1.36\pm0.65$, $Y=10\pm5$, Mt=metal.

15 Claims, 1 Drawing Sheet

DOPED FINE GRAIN SILVER HALIDE GRAINS AS A MEANS OF INCORPORATING METAL DOPANT IN EMULSION FINISHING

FIELD OF THE INVENTION

The invention relates to the sensitization of silver halide emulsion grains for use in a photographic element. The invention particularly relates to a process of chemically and spectrally sensitizing silver halide emulsions involving the incorporation of useful metal dopant compounds in such a manner as to provide more efficient metal dopant incorporation.

BACKGROUND OF THE INVENTION

In the formation of silver halide emulsions for use in photographic materials, a desirable characteristic is to have photographic materials that are capable of being rapidly processed. It is known that silver halide emulsions having high levels of chloride content (greater than 90 mole % chloride) are especially useful in achieving rapid processability due to their higher solubility compared to emulsions having greater than some minimum levels of other halides (for example, emulsions having greater than 10 mole % bromide or more than 3–5 mole % iodide or both).

Silver halide emulsions including those high in chloride content are also known to require some form of chemical sensitization in order to increase their photographic efficiency. Chemical sensitization of an emulsion involves the addition of one or more chemical sensitizing agents where the sensitizing agent is capable of undergoing a chemical reaction on the silver halide grain surface during the application of thermal energy for some time period. The chemical sensitization involving adding chemical sensitizer to an emulsion and heating is often referred to as chemical digestion of the silver halide emulsion. Emulsions, especially high chloride content emulsions also require spectral sensitization involving the addition of surface adsorbing sensitizing dyes to the emulsion grains which make the grains sensitive to specific wavelengths of light. In addition, silver halide emulsion grains are often treated with other photographically useful chemical compounds such as salts of other halides which can cause surface conversion of the host emulsion grains to a mixed halide composition. Other known photographically useful compounds which can be added are antifoggants, stabilizers, metal dopants, silver halide solvents, ripeners, supersensitizers, coating aids and surfactants. These photographically useful compounds can be added prior to, during, or after the chemical sensitization or the spectral sensitization steps.

It is known that silver halide emulsions, including those high in chloride content, often exhibit substantial reciprocity law failure which can limit their usefulness. That is, say these emulsions can exhibit a large change in photographic sensitivity and gradation due to a change in the illuminance of exposure. It is also known to incorporate certain metal dopant compounds to the silver halide emulsion grains in order to improve the reciprocity performance of these emulsions. It is further known that in order for the metal dopant to be effective in modifying silver halide emulsion performance such as reciprocity law failure, the metal dopant must be incorporated into the silver halide crystal which can be accomplished either during grain formation or during the sensitization process. It is also known that if the metal dopant is to be added after the emulsion grain formation as part of the finishing, it is necessary to perform a surface halide conversion to cause the dopant to be incorporated.

The terms photographic "sensitivity" and "speed" are used interchangeably herein, as are "gradation" and "contrast".

It has been disclosed in U.S. Pat. No. 5,284,745 —Ohshima and in U.S. Pat. No. 5,391,474 —Haefner et al that high silver bromide content localized phases may be formed on high silver chloride content host emulsions by the use of fine grain silver bromide emulsions having iridium incorporated therein.

U.S. Ser. No. 08/390,450 filed Feb. 17, 1995, now U.S. Pat. No. 5,523,200, with inventors Hahm et al also discloses that iridium, as well as other materials, may be added by the use of Lippmann emulsions.

PROBLEM TO BE SOLVED BY THE INVENTION

There is a continuing need for means to improve the reciprocity performance of chemically and spectrally sensitized silver halide emulsions, including emulsions containing high levels of chloride. There is also a continuing need for more effective ways to incorporate iridium and surface bromide with use of less material in order to increase the reciprocity improvement achieved with the iridium without causing any harmful effects by application of too much iridium or bromide to the surface of the grain. Too much iridium or bromide could lead to problems such as a decrease in latent image keeping properties or lower contrast.

SUMMARY OF THE INVENTION

It is an object of this invention is to provide sensitized emulsions containing high levels of chloride which exhibit improved speed and reciprocity performance.

Another object of this invention is to provide a means of more efficient incorporation of metal dopant compounds in the process of sensitizing emulsions containing high levels of chloride.

These and other objects of the invention are generally accomplished by a method of forming a sensitized high chloride silver halide emulsion comprising providing a high chloride emulsion bringing a Lippmann emulsion comprising fine grains of silver bromide doped with metal into contact with said emulsion at a temperature of above 50° C. wherein said metal is present in an amount between 0.001 and 0.25 mg/silver mole, said bromide is present in an amount between 0.05 and 3.0 mole percent bromide and the relationship of bromide and metal is mole percent $Br=X^{-(Y\cdot Mt)}$, X=1.36±0.65, Y=10±5, Mt=metal.

ADVANTAGEOUS EFFECT OF THE INVENTION

The invention provides silver halide emulsions having improved speed and reciprocity. The invention provides more efficient incorporation of metal dopant and bromide during the finishing process and increases the effectiveness of the dopant used, thereby allowing less to be used to get the same effect.

DETAILED DESCRIPTION OF THE INVENTION

Figure 1:
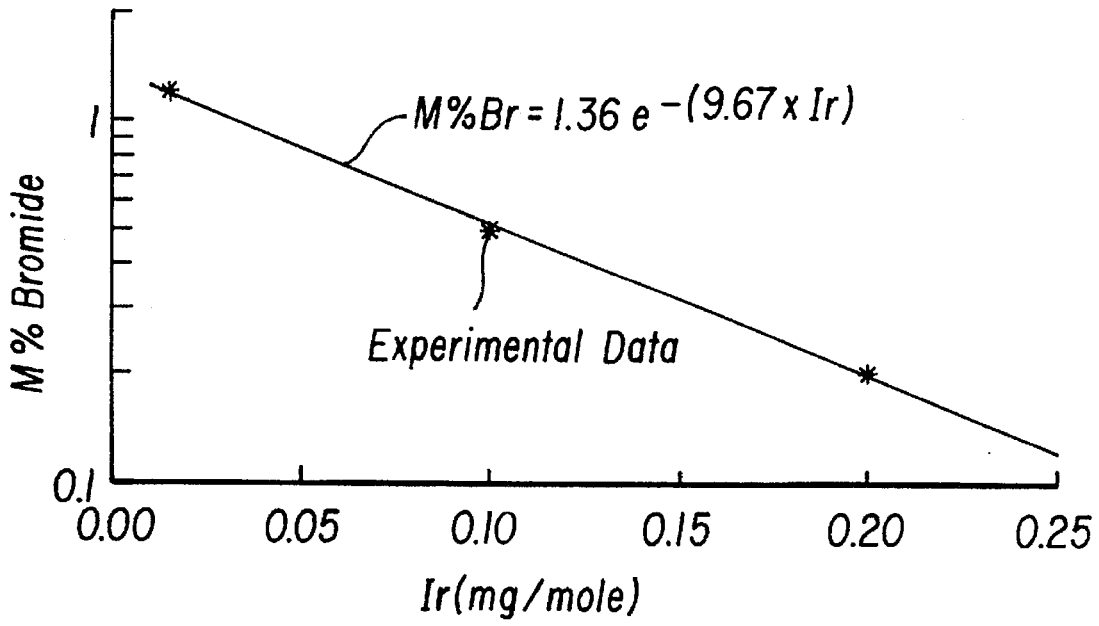
FIG. 1 is a graph showing the relationship between the amount of iridium and bromide in an emulsion of the invention.

The invention has numerous advantages over prior techniques of adding iridium to silver halide grains. By means of the instant technique with careful control of temperature of addition in iridium in a Lippmann emulsion, as well as control of the amount of bromide and iridium, it is possible to more effectively utilize the iridium to achieve the increased reciprocity performance of the grains of the invention. The invention allows the use of less iridium in order to achieve the same effect as previously required. The invention also allows use of less bromide, thereby improving keeping and improving contrast. These and other advantages will become apparent from the description below.

The invention utilizes Lippmann bromide fine grain emulsions of a grain size of 0.02 microns to about 0.08 microns in the average linear dimension. These grains are doped with a metal that is active in the finishing of silver chloride grains. Such metals include compound of copper, thallium, lead, bismuth, mercury, zinc, cadmium, rhenium, and Group VIII metals such as iron, ruthenium, rhodium, palladium, and platinum. The metals found to be most effective when utilized in the invention are osmium and iridium, with the iridium being most preferred for control of reciprocity failure in the high chloride grains. The chloride grains utilized in the invention generally have greater than 90% chloride, and most preferably greater than 95% chloride. The remainder of the grain generally is bromide at or near the surface and iodide placed in the grain during the grain formation. The metal is generally added to Lippmann emulsions as a ligand such as halo, aquo, cyano, cyanate, thiocyanate, nitrosyl, oxo, and carbonyl ligands, or combinations thereof. When the preferred iridium materials added are generally provided in an amount of between 0.001 milligrams per silver mole to 0.25 milligrams per silver mole, it is preferred that the amount be between 0.005 and 0.2 per silver mole. In accordance with the invention, the bromide generally is added in an amount between about 0.05 and 3.0 mole percent bromide.

The invention method has bromide and metal introduced to the grain during finishing in the following relationship:

$$M\ \%\ Br = Xe^{-(Y \cdot Mt)}$$

wherein

X=1.36±0.68

Y=10±5

Mt=metal in milligrams per silver mole e=the natural logarithm function (approximately 2.71828 , , , ).

It is preferred that when Ir is the metal, X equals about 1.36 and Y equals about 10.

The Lippmann bromide may be added at any temperature that achieves the desired placement of the iridium and bromide on the grain. Typically, such temperatures are between about 40° and 80° C., when found to be preferred to add the bromide between about 50° and 55° C. in order to achieve the most effective reciprocity improvement with the use of the least iridium.

The silver halide emulsions of this invention can be precipitated by any of the methods known in the art, for example, those described in T. H. James, *The Theory of the Photographic Process* (4th Ed.), *Research Disclosure* 36544 of September 1994 in Sections I–III, or *Research Disclosure* 37038 of February 1995 in Section XV. The silver halide emulsions should be high in chloride content meaning at least about 90 mole % chloride, preferably at least about 95 mole % chloride and most preferably at least 97 mole % chloride for rapid processing and good image formation. Some bromide may be incorporated during a late stage of precipitation, but the most preferred method of bromide incorporation is addition after the formation of silver chloride grains by a surface conversion process. The emulsion should also contain less than 5 mole % iodide, preferably less that 2 mole %, and most preferably less than 1 mole % iodide. The source of either the added bromide or iodide may be any of the commonly known salts, complexes, or compounds which can suitably release the halide.

Emulsion precipitation may be conducted in the presence of any of the commonly known dispersing media including gelatin, synthetic polymers or peptizers, and conditions of precipitation may include any specific means to avoid fog such as control of pAg and pH. Furthermore, other chemical agents may also be present during the silver halide emulsion precipitation such as oxidizing agents, antifoggants, sensitizing dyes or other photographically useful compounds as described in *Research Disclosure* 37038 of February 1995 in Section XV. It is specifically contemplated to use thiosulfonate compounds alone or in combination with sulfinates or selinates during the preparation or treatment of these emulsions.

It is also contemplated to use one or more of the known useful metal dopants in preparing these high chloride content silver halides in order to modify the emulsion performance, especially reciprocity performance. Metal dopants include salts or coordination complexes, especially hexacoordination complexes with ligands such as halo, aquo, cyano, cyanato, thiocyanoto, nitrosyl, oxo, and carbonyl ligands or combinations thereof. Suitable metal dopants are salts or coordination complexes of Group VIII metals (e.g., iron, ruthenium, rhodium, palladium, osimum, ididium and platinum). The most preferred dopants are salts or complexes of the metals Ir, Os, Ru and Fe. The most preferred dopant for the invention is Iridium, as it has been shown that it may be readily incorporated by Lippmann emulsion and reduce reciprocity failure. Specific example of these dopants are described in *Research Disclosure* 37038 of February 1995 in Section XV, Part B.

The invention incorporates metal dopants by means of surface conversion of the host emulsion grains with a doped fine grain silver halide emulsion. In the invention it is also possible to employ a mixture of fine grain (Lippmann) silver halide emulsions, doped and undoped in order to independently control the extent of the halide conversion of the host grain as well as controlling the dopant level. This allows change of the ratio of bromide and iridium or other metal, without change in the composition of the metal containing Lippmann bromide.

The sensitization of silver halide emulsions, especially the high chloride content emulsions according to this invention, involves subjecting the silver halide grains to a heat treatment step during which any common photographically useful compound might be present. Alternatively, the emulsion may be subjected to a double heat treatment, wherein the first heat treatment is the chemical sensitization (digestion) step and the second heat treatment is a step performed in the presence of other chemical compounds known to be photographically useful. It is contemplated that the thermal history of the silver halide emulsion during any of the heat treatment steps will be chosen in such a way that the treatment temperature and time will give an optimum final emulsion performance. The temperature and time will depend on the choice and level of the chemical compounds that are present in the emulsion before, or during the heat treatment steps. The temperature of the heat treatment steps should be greater than that required to simply melt the silver halide emulsion and gelatin mixture, typically above 45° C., but usually less than about 80° C. The upper temperature of about 80° C. is determined by the rapid rate of chemical reactions at higher temperature, by thermal degradation of the gelatin, or by excessive evaporation, although evaporation may be minimized by covering the reaction vessel during heating. A finishing temperature between 50° and 65° C. has been found to be most suitable. A temperature between 50° and 55° C. has been found to be most preferred for effective Ir placement.

The chemical sensitization (digestion) can be accomplished by any of a variety of known chemical sensitizing agents such as those described in *Research Disclosure* 37038 of February 1995 in Section XV. The preferred sensitizing agents would be sulfiding agents, sources of gold, combinations of sulfur and gold, or aqueous colloidal gold sulfide because of the ability these agents have to produce substantially higher emulsion speed/sensitivity as compared to the untreated emulsion.

The following examples illustrate the practice of the invention. They are not intended to be exhaustive of all possible variations of the invention.

EXAMPLE 1

EMULSION A:

Precipitation of 10.0 mole Laboratory-scale Silver Chloride Host Emulsion Reactor:

Demineralized water, 7.4 liters

Gelatin, 40.9 grams/liter

Sodium chloride salt, 2.19 grams/liter

Thioether ripener (I), 0.15 grams/liter

Temperature maintained at 46.0° C.

Solution 1: Silver nitrate, 475.7 grams/liter

Solution 2: Sodium chloride, 175.4 grams/liter

Solution 3: Dopant $Cs_2Os(NO)Cl_5$, 1.67 μg/Ag mole

The precipitation is carried out by simultaneously adding solutions 1 and 2 to the well-stirred contents of the reactor. Silver nitrate is added at a rate of 0.633 moles/minute, while the sodium chloride is added in a manner to maintain the pAg relatively constant in the reactor. The dopant solution (solution 3) is added along with silver and salt from the start of precipitation to a point where 93% of the total mass of silver is added. After a total precipitation time of 15.8 minutes, the reactor temperature is reduced to 40.0° C. and the silver chloride emulsion grains are desalted by diafiltration. The final emulsion grain size was determined to be approximately 0.30 micrometers in mean cubic edge length.

EMULSION B:

Precipitation of 10.0 mole Laboratory-scale Fine Grain AgBr as the Bromide Source for Surface Conversion of Host Reactor:

Demineralized water, 7.9 liters

Gelatin, 46.9 grams/liter

Sodium bromide salt, enough to adjust pAg to 8.9

Temperature maintained at 40.0° C.

Solution 1: Silver nitrate, 424.7 grams/liter

Solution 2: Sodium bromide, 257.3 grams/liter

The precipitation is carried out by simultaneously adding solutions 1 and 2 to the well-stirred contents of the reactor. Silver nitrate is added at a rate of 0.5 moles/minute, while the sodium bromide is added in a manner to maintain the pAg relatively constant in the reactor during the first 3 minutes. After the first 3 minutes, silver and bromide are added with a slight imbalance to cause the pAg to decrease over the next 16 minutes to a pAg of 8.1 which is maintained for the last minute of the precipitation. After a total precipitation time of 20 minutes, the silver bromide emulsion grains are desalted by diafiltration. The final emulsion grain size is approximately 0.05 micrometers in mean diameter. Finally, the emulsion is treated with AF-1 at 0.515 grams/Ag mole and additional gelatin is added to bring the sample up to 5% gel by weight.

Desalted emulsion A is divided into smaller well-stirred samples for treatment as follows:

SENSITIZATION A: (COMPARISON)

Sample A1 (no dopant in finish): An emulsion sample is melted at 40.0° C., the pH is adjusted to 5.7 and the pAg is adjusted to 7.6 and then, (a) Colloidal gold sulfide is added to the emulsion, 20.1 mg $Au_2S$/Ag mole.

(b) The emulsion is heated to 55.0° C. at a rate of 1.67° C./minute.

(c) After 27 minute at 55.0° C., no dopant MD-1 is added.

(d) After 33 minutes at 55.0° C., add fine grain emulsion B at 0.5 mole % Br/Ag mole.

(e) After 53 minutes at 55.0° C., add GSD-1 at 442 mg/Ag mole.

(f) After 63 minutes at 55.0° C., the emulsion sample is cooled to 40.0° C. at a rate of 1.67° C./minute.

(g) 10 seconds after cooling begins, add AF-1 at 162 mg/Ag mole.

(h) Sample pH is adjusted to 5.4, add KCl at 12.19 g/Ag mole.

(i) Emulsion sample is chill-set for later remelting and coating.

Sample A2: This sample is treated like Sample A1 except that after 27 minutes at a temperature of 55.0° C., adding dopant MD-1 at 0.122 mg/Ag mole.

Sample A3: This sample is treated like Sample A1 except that after 27 minutes at a temperature of 55.0° C., adding dopant MD-1 at 0.243 mg/Ag mole.

Sample A4: This sample is treated like Sample A1 except that after 27 minutes at a temperature of 55.0° C., adding dopant MD-1 at 0.365 mg/Ag mole.

Sample A5: This sample is treated like Sample A1 except that after 27 minutes at a temperature of 55.0° C., adding dopant MD-1 at 0.487 mg/Ag mole.

SENSITIZATION B: (INVENTION)

Sample B2: An emulsion sample is melted at 40.0° C., the pH is adjusted to 5.7 and the pAg is adjusted to 7.6 and then, (a) Colloidal gold sulfide is added to the emulsion, 20.1 mg $Au_2S$/Ag mole.

(b) The emulsion is heated to 55.0° C. at a rate of 1.67° C./minute.

(c) After 33 minutes at 55.0° C., add fine grain doped AgBr at 0.5 moles % Br/Ag mole, said emulsion being doped at 73 mg of MD- 1/mole of AgBr which results in an effective MD-1 dopant level of 0.365 mg/Ag mole which is a level equal to sample A4. (The preparation of the doped fine grain AgBr is as Emulsion D except that 73 mg of MD- 1/Ag mole is added instead of 6.00 mg of MD- 1/Ag Mole.)

(d) After 53 minutes at 55.0° C., add GSD-1 at 442 mg/Ag mole.

(e) After 63 minutes at 55.0° C., the emulsion sample is cooled to 40.0° C. at a rate of 1.67° C./minute.

(f) 10 seconds after cooling begins, add AF-1 at 162 mg/Ag mole.

(g) Sample pH is adjusted to 5.4, add KCl at 12.19 g/Ag mole.

(h) Emulsion sample is chill-set for later remelting and coating.

Sample B3: This sample is treated like Sample B2 except that the amount of doped fine grain AgBr added after 33 minutes at a temperature of 55.0° C. is 0.5 moles % Br/Ag mole, said fine grain emulsion being doped at 48.7 mg of MD-1/mole of AgBr.

Sample B4: This sample is treated like Sample B2 except that the amount of doped fine grain AgBr added after 33 minutes at a temperature of 55.0° C. is 0.5 moles % Br/Ag mole, said fine grain emulsion being doped at 24.3 mg of MD-1/mole of AgBr.

Sample B5: This sample is treated like Sample B2 except that the amount of fine grain AgBr added after 33 minutes at a temperature of 55.0° C. is 0.5 moles % Br/Ag mole, said fine grain emulsion being an undoped comparison and which is prepared as Sample A1.

FORMAT FOR EMULSION PERFORMANCE EVALUATION

A multicolor, multilayer coating was prepared as a photographic recording element of this invention using the example emulsions in the green sensitive/magenta dye imaging silver halide layer in the following structure:

For the examples in Table I

| |
|---|
| Gel overcoat layer, 0.807 g gel/sq. meter |
| Red sensitive/cyan dye imaging silver halide layer<br>Gel at 1.615 g/sq. meter<br>Silver coverage = 0.265 g Ag/sq. meter<br>Coupler CC-1 at 0.422 g/sq. meter |
| Interlayer |
| Green sensitive/magenta dye imaging silver halide layer<br>Gel at 1.206 g/sq. meter<br>Silver coverage = 0.195 g Ag/sq. meter<br>Coupler MC-2 at 0.422 g/sq. meter |
| Interlayer |
| Blue sensitive/yellow dye imaging silver halide layer<br>Gel at 1.453 g/sq. meter<br>Silver coverage = 0.223 g Ag/sq. meter<br>Coupler YC-2 at 0.484 g/sq. meter |
| Polyethylene Coated Reflection support |

For the examples in Table II

| |
|---|
| Gel overcoat layer, 1.076 g gel/sq. meter |
| Red sensitive/cyan dye imaging silver halide layer<br>Gel at 1.430 g/sq. meter<br>Silver coverage = 0.240 g Ag/sq. meter<br>Coupler CC-1 at 0.422 g/sq. meter |
| Interlayer |
| Green sensitive/magenta dye imaging silver halide layer<br>Gel at 1.237 g/sq. meter<br>Silver coverage = 0.122 g Ag/sq. meter<br>Coupler MC-1 at 0.355 g/sq. meter |
| Interlayer |
| Blue sensitive/yellow dye imaging silver halide layer<br>Gel at 1.506 g/sq. meter<br>Silver coverage = 0.218 g Ag/sq. meter<br>Coupler YC-1 at 1.076 g/sq. meter |
| Polyethylene Coated Reflection support |

PHOTOGRAPHIC PERFORMANCE EVALUATION

Each of the multicolor, multilayer coatings was exposed by a 1700 Lux tungsten lamp with a 3000° K. temperature for 0.5 seconds followed by processing in KODAK EKTACOLOR RA-4 chemistry in a roller transport processor. Filtration for the red sensitive layer was a Wratten 70, for the green sensitive layer a Wratten 99+0.3 neutral density, and for the blue Wratten 48+2B+0.8 neutral density. Emulsion coating performance was judged by measuring photographic sensitivity (speed) in relative Log exposure units at a density of 0.8. HIRF speed difference between a 0.5 second reference exposure and a higher intensity exposure at 0.031 second time were made using a 3300 Lux tungsten lamp with a 3000° K. temperature. The 0.5 second exposure was made using a 1.5 neutral density Inconel filter, while the neutral density chosen for the 0.031 second exposure time was reduced to give an equal relative log exposure, followed by processing in KODAK EKTACOLOR RA-4 chemistry in a roller transport processor.

TABLE I

| | Dopant in Finish Performance Comparison | | | |
|---|---|---|---|---|
| Relative level of Ir/Ag mole | G_Speed Ir added first followed by LBr (comparison) | HIRF G_Speed Ir added first followed by LBr (comparison) | G_Speed Ir doped LBr added (invention) | HIRF G_Speed Ir doped LBr added (invention) |
| undoped | 1.66 | −0.06 | 1.66 | −0.06 |
| 0.33 | 1.68 | −0.04 | 1.60 | −0.01 |
| 0.67 | 1.64 | −0.03 | 1.51 | 0.0 |
| 1.0 | 1.62 | −0.01 | 1.47 | 0.0 |
| 1.33 | 1.61 | — | — | — |

It can clearly be seen from Table I that relative to the comparison samples, at the same total Ir dopant level added the invention provides a larger loss in G_Speed and a larger reduction in the HIRF speed delta both indicating more effective incorporation of the dopant into the host emulsion grains.

EXAMPLE 2

EMULSION C:

Precipitation of 10.0 mole Laboratory-scale Silver Chloride Emulsion Reactor::

Demineralized water, 5.4 liters

Gelatin, 38.3 grams/liter

Sodium chloride salt, 2.12 grams/liter

Thioether ripener (I), 0.2 grams/liter

Temperature maintained at 46.0° C.

Solution 1: Silver Nitrate, 475.7 grams/liter

Solution 2: Sodium Chloride, 175.4 grams/liter

The precipitation is carried out by simultaneously adding solutions 1 and 2 to the well-stirred contents of the reactor. Silver nitrate is added at a rate of 0.465 moles/minute, while the sodium chloride is added in a manner to maintain the pAg relatively constant in the reactor. After a total precipitation time of 21.5 minutes, the reactor temperature is reduced to 40.0° C. and the silver chloride emulsion grains are desalted by diafiltration. The final emulsion grain size was determined to be approximately 0.38 micrometers in mean cubic edge length.

EMULSION D:

The precipitation is carried out in a similar manner to that of emulsion B, except that metal dopant MD-1 is added from 3 minutes into the precipitation to 19 minutes into the precipitation at a level of 2.865 mg of MD-1/Ag mole. After a total precipitation time of 20 minutes, the doped silver bromide emulsion grains are desalted by diafiltration. The final emulsion grain size is approximately 0.05 micrometers in mean diameter. Finally, the emulsion is treated with AF-1 at 0.515 grams/Ag mole and additional gelatin is added to bring the sample up to 5% gel by weight.

SENSITIZATION C: (COMPARISON)

Sample C1 (no dopant in finish): An emulsion sample is melted at 40.0° C., the pH is adjusted to 5.7 and the pAg is adjusted to 7.6 and then, (a) Colloidal gold sulfide is added to the emulsion, 29 mg $Au_2S$/Ag mole.

(b) The emulsion is heated to 55.0° C. at a rate of 1.67° C./minute.

(c) After 27 minutes at 55.0° C., no dopant MD-1 is added.

(d) After 33 minutes at 55.0° C., add fine grain emulsion B at 1.2 mole % AgBr (undoped).

(e) After 53 minutes at 55.0° C., add GSD-1 at 350 mg/Ag mole.

(f) After 63 minutes at 55.0° C., the emulsion sample is cooled to 40.0° C. at a rate of 1.67° C./minute.

(g) One minute after cooling begins, add AF-1 at 128 mg/Ag mole.

(h) Sample pH is adjusted to 5.4, add KCl at 7.85 g/Ag mole.

(i) Emulsion sample is chill-set for later remelting and coating.

Sample C2: This sample is treated like Sample C1 except that after 27 minutes at a temperature 55.0° C., adding dopant MD-1 at 0.05 mg/Ag mole.

Sample C3: This sample is treated like Sample C1 except that after 27 minutes at a temperature 55.0° C., adding dopant MD-1 at 0.11 mg/Ag mole.

Sample C4: This sample is treated like Sample C1 except that after 27 minutes at a temperature 55.0° C., adding dopant MD-1 at 0.21 mg/Ag mole.

Sample C5: (Invention) This sample is treated like Sample C1 except that an effective MD-1 dopant level of 0.05 mg/Ag mole is added by adding a fine grain doped and undoped mixture at 1.2 mole % Br, where the AgBr is prepared by mixing 71% of the emulsion D which is doped at 6.00 mg of MD- 1/AgBr mole and 29% of the undoped emulsion B.

Sample C6: (Invention) This sample is treated like Sample C 1 except that an effective MD-1 dopant level of 0.03 mg/Ag mole is added by adding a fine grain doped and undoped mixture at 1.2 mole % Br, where the AgBr is prepared by mixing 36% of the doped emulsion D and 64% of undoped emulsion B.

Sample C7: (Invention) This sample is treated like Sample C1 except that an effective MD-1 dopant level of 0.01 mg/Ag mole is added by adding a fine grain doped and undoped mixture at 1.2 mole % Br, where the AgBr is prepared by mixing 18% of the doped emulsion D and 82% of undoped emulsion B.

Sample C8: (Invention) This sample is treated like Sample C1 except that an effective MD-1 dopant level of 0.1 mg/Ag mole is added by adding a fine grain doped and undoped mixture at 1.2 mole % Br, where the AgBr is prepared by mixing 36% of the doped emulsion prepared like emulsion D except with 24 mg of MD-1 mg/AgBr mole and with 64% of undoped emulsion B.

Sample C9: (Undoped Control for Invention) Sample is prepared as C1 at 1.2 mole % AgBr without dopant.

TABLE II

| Level of Ir/Ag mole (mg/Ag mole) | HIRF G_Speed Ir added first followed by LBr (comparison) | HIRF G_Speed Ir doped LBr added (invention) |
|---|---|---|
| 0 | −0.12 | −0.12 |
| 0.01 | — | −0.04 |
| 0.03 | — | −0.029 |
| 0.05 | −0.09 | −0.01 |
| 0.1 | — | −0.008 |
| 0.11 | −0.02 | — |
| 0.21 | −0.017 | — |

It can be seen from Table II that relative to the comparison samples, the invention provides a comparable reduction in the HIRF speed delta at a lower level of added dopant, indicating more effective incorporation of the dopant into the host emulsion grains.

EMULSION E:

Many emulsions are formed as Sensitization C and tested in the same format as the examples shown in Table II. And, from these results preferred iridium levels are selected and verified for 0.2, 0.5, and 1.2 mole percent Br. These preferred iridium and bromide combinations are listed in Table III.

TABLE III

| Ir mg/mole | Mole Percent Br |
|---|---|
| 0.2 | 0.2 |
| 0.1 | 0.5 |
| 0.015 | 1.2 |

These preferred iridium and bromide combinations are plotted in FIG. 1. As shown, the plotting of the points on the graph leads to the preferred formula:

$$M\ \%\ Br = 1.36e^{-(9.67 \times Ir)}$$

The optimum iridium level can depend on the level of bromide as can be seen by comparing Table I and Table II. Generally, the higher the bromide, the less iridium is needed to control reciprocity. The level of bromide can be used to optimize emulsion contrast, as well as many other responses. The optimized iridium levels for 0.5 and 1.2 mole % bromide per Ag mole for the normal mode of iridium addition before the LBr and the invention with iridium doped LBr based on the formulations described in Table I and Table II are summarized in the following table:

TABLE IV

| Bromide Level | Iridium-Before-LBr (Comparison) | Iridium-doped-LBr (Invention) |
|---|---|---|
| 0.5 M % Br | 0.365 mg | 0.12 mg |
| 1.2 M % Br | 0.06–0.12 mg | 0.015 mg |

The increased effectiveness is seen whether a single doped LBr emulsion is added or whether a mixture of doped and undoped LBr emulsions are added.

GSD-1
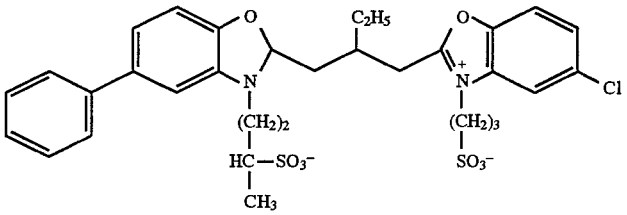
$Na^+$
or
1/2 $Ca^{+2}$
or
$HN^+(C_2H_5)_3$
AF-1
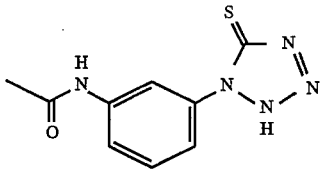
SS-1
NaH
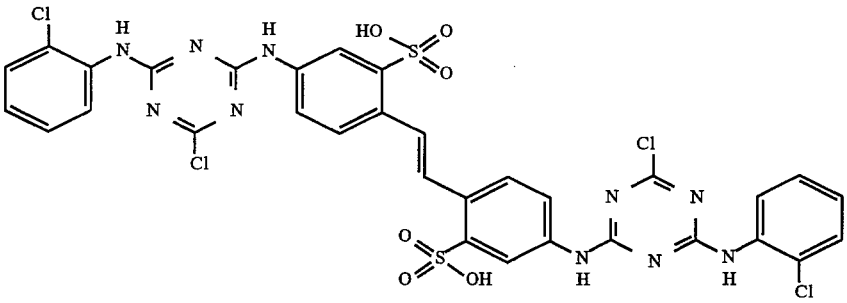
AF-Z
KH
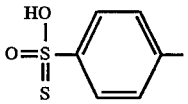
10 parts
NaH
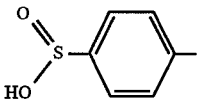
1 part
MD-1 = $K_2Ir(Cl)_6$
ASD-1
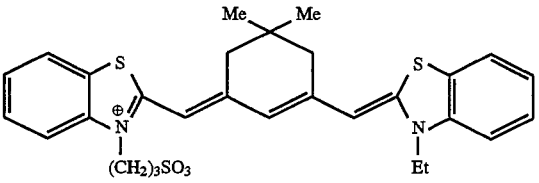
CC-1

-continued
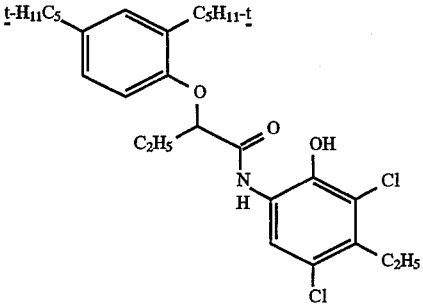
MC-1
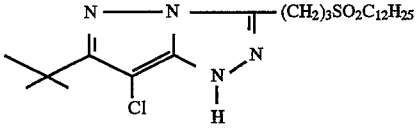
YC-1
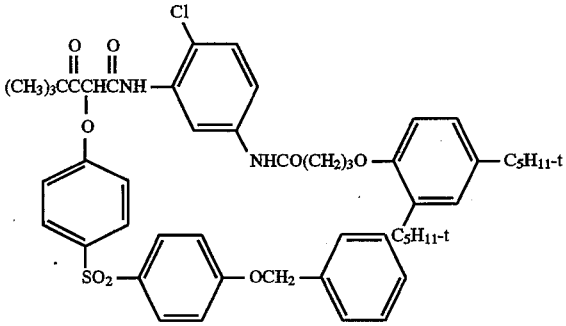
MC-2
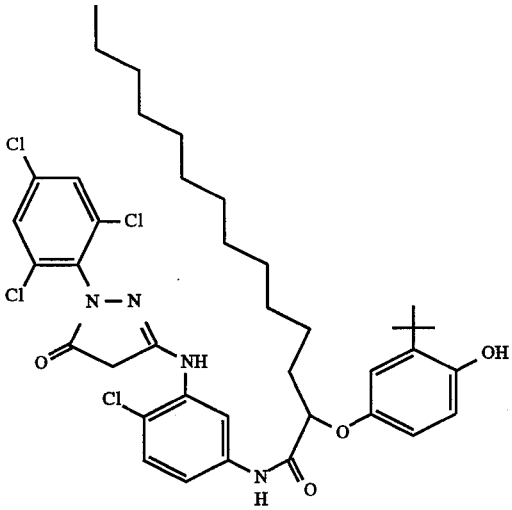
YC-2
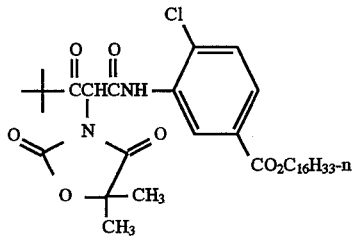
I = 2,2'-(ethylene-dithiodiethanol)

The invention has been described in detail with particular reference to preferred embodiments thereof, but it will be understood that variations and modifications can be effected within the spirit and scope of the invention.

We claim:

1. A method of forming a sensitized high chloride content silver halide emulsion comprising providing a high chloride content emulsion, bringing a Lippmann emulsion comprising fine grains of silver bromide doped with metal into contact with said high chloride emulsion at a temperature of above 50° C. wherein said metal is present in an amount between 0.001 and 0.25 mg/silver mole, said bromide is present in an amount between 0.05 and 3.0 mole percent bromide with respect to silver and the relationship of bromide and metal is Mole percent $Br=Xe^{-(Y\cdot Mt)}$, $X=1.36\pm0.65$, $Y=10\pm5$, Mt=metal in milligrams per silver mole.

2. The method of claim 1 wherein said metal comprises Iridium.

3. The method of claim 1 wherein said metal is iridium and said iridium is present in an amount of 0.005 mg/silver mole to 0.2 mg/silver mole.

4. The method of claim 1 wherein said high chloride content emulsion has a grain size of 0.15 microns to 1.5 microns in cubic edge length.

5. The method of claim 1 wherein said Lippmann fine grain emulsion has a grain size of 0.02 microns to 0.08 microns in linear dimension.

6. The method of claim 1 wherein an undoped Lippmann fine grain emulsion is also brought into contact with said high chloride emulsion.

7. The method of claim 1 wherein said high chloride content emulsion comprises cubic grains.

8. The method of claim 1 wherein said Lippmann fine grain emulsion is added after heating said high chloride content emulsion to a temperature of between 50° and 55° C.

9. A method of claim 1 wherein said bromide is present in an amount between 0.2 and 2.0 mole percent bromide with respect to silver.

10. The method of claim 1 wherein said high chloride content emulsion has a grain size of 0.2 microns to 1.0 microns in cubic edgelength.

11. The method of claim 1 wherein said metal comprises iridium and X is about 1.36 and Y is about 10.

12. The method of claim 1 wherein said metal is osmium.

13. The method of claim 1 wherein said metal is selected from the group consisting of copper, thallium, lead, bismuth, mercury, zinc, cadmium, rhenium, iron, ruthenium, rhodium, palladium, platinum, osmium, and iridium.

14. The method of claim 1 wherein said Lippmann emulsion is brought into contact with said emulsion during finishing.

15. The method of claim 1 wherein said Lippmann emulsion is brought into contact with said emulsion during chemical sensitization.

* * * * *